US010677513B2

(12) United States Patent
Staud et al.

(10) Patent No.: US 10,677,513 B2
(45) Date of Patent: Jun. 9, 2020

(54) REFRIGERATION APPLIANCE WITH AN ICE/WATER DISPENSER

(71) Applicant: BSH HAUSGERAETE GMBH, Munich (DE)

(72) Inventors: Ralph Staud, Munich (DE); Thomas Tischer, Haar (DE); Philipp Kleinlein, Munich (DE); Andreas Kessler, Munich (DE); Graham Sadtler, Huntington Beach, CA (US); Heather Kamper, Newport Beach, CA (US); Karl-Friedrich Laible, Langenau (DE); Bernd Brabenec, Giengen (DE)

(73) Assignee: BSH Hausgeraete GmbH, Munich (DE)

( * ) Notice: Subject to any disclaimer, the term of this patent is extended or adjusted under 35 U.S.C. 154(b) by 185 days.

(21) Appl. No.: 15/744,541

(22) PCT Filed: Jun. 24, 2016

(86) PCT No.: PCT/EP2016/064679
§ 371 (c)(1),
(2) Date: Jan. 12, 2018

(87) PCT Pub. No.: WO2017/016768
PCT Pub. Date: Feb. 20, 2017

(65) Prior Publication Data

US 2018/0209718 A1 Jul. 26, 2018

(30) Foreign Application Priority Data

Jul. 24, 2015 (DE) ..... 10 2015 214 023

(51) Int. Cl.
*F25D 23/04* (2006.01)
*F25D 23/12* (2006.01)
(Continued)

(52) U.S. Cl.
CPC ..... *F25D 23/04* (2013.01); *F25C 5/20* (2018.01); *F25D 23/025* (2013.01);
(Continued)

(58) Field of Classification Search
CPC ..... F25D 23/02; F25D 23/025; F25D 23/126; F25D 2331/81; F25D 23/04; F25D 23/028; F25C 5/20
See application file for complete search history.

(56) References Cited

U.S. PATENT DOCUMENTS 2,276,937 A * 3/1942 Arturo Cordova ..... F25D 23/04 222/130
2,945,733 A * 7/1960 Malia ..... F25D 23/04 312/200
(Continued)

FOREIGN PATENT DOCUMENTS

EP 2131123 A2 12/2009
EP 2444761 A2 4/2012

*Primary Examiner* — Andrew D StClair
(74) *Attorney, Agent, or Firm* — Laurence A. Greenberg; Werner H. Stemer; Ralph E. Locher

(57) ABSTRACT

A refrigeration appliance includes a body, an external door that can pivot relative to the body, and an internal door which can pivot relative to the body and the external door and which is immobilized between the body and the external door in the closed position of the external door. A dispensing or output recess of a dispenser is provided in the internal door.

10 Claims, 3 Drawing Sheets

(51) Int. Cl.
*F25D 23/02* (2006.01)
*F25C 5/20* (2018.01)

(52) U.S. Cl.
CPC ..... *F25D 23/028* (2013.01); *F25D 23/126* (2013.01); *F25D 2331/81* (2013.01)

(56) References Cited

U.S. PATENT DOCUMENTS

| | | | | |
|---|---|---|---|---|
| 4,087,140 | A * | 5/1978 | Linstromberg | F25D 23/02 312/292 |
| 5,855,120 | A * | 1/1999 | Kim | B67D 1/10 417/12 |
| 6,681,585 | B1 * | 1/2004 | Stagg | B67D 1/0871 62/177 |
| D527,398 | S | 8/2006 | Kim et al. | |
| 7,658,212 | B2 * | 2/2010 | Meuleners | F25D 23/126 141/360 |
| 8,312,735 | B2 * | 11/2012 | Fulton | F25C 5/187 62/344 |
| 8,745,992 | B2 | 6/2014 | Cheong et al. | |
| 2011/0023527 | A1 | 2/2011 | Kwon et al. | |

* cited by examiner

REFRIGERATION APPLIANCE WITH AN ICE/WATER DISPENSER

BACKGROUND OF THE INVENTION

Field of the Invention

The present invention relates to a refrigeration appliance, in particular a domestic refrigeration appliance, with a dispenser, in particular for ice and/or cooled water.

Refrigeration appliances, in which an output recess of the dispenser is accommodated in an external door of the refrigeration appliance and opens downward, are currently largely widely used on the market. The recess on the exterior of the door corresponds to a projection on the interior, which projects into a cooled storage chamber of the refrigeration appliance and reduces its usable volume. The output recess itself is at ambient temperature.

These conventional dispensers are complex to install since a water line has to be laid from the body through a door hinge and the door to the output recess and must be able to follow the movements of the door without becoming leaky.

Refrigeration appliances have recently also been proposed, in which the dispenser is installed in the body in order to output ice or water into a container positioned in the storage chamber. One advantage of these appliances is the simpler structure, another is the reduced restriction of the usable volume of the storage chamber, since part of the complex insulation, which is required around an output recess which opens downward, can be omitted.

A further space saving is produced from the possibility of accommodating refrigerated goods also directly below an output of the dispenser, because this space is also cooled since it is part of the storage chamber. However, refrigerated goods which are disposed there must firstly be cleared aside if the dispenser is to be used.

SUMMARY OF THE INVENTION

The object of the present invention is to specify a refrigeration appliance, in which the restriction to the usability of a cooled storage chamber is minimized by an internal dispenser.

In the case of a refrigeration appliance with a body and an external door that can move, in particular pivot relative to the body, said external door concealing an output recess of a dispenser for ice and/or water in a closed position, according to a first aspect of the invention, the object is achieved by a door tray being attached to the external door, which in the closed position engages into the output recess. The door tray allows the output recess to be used to accommodate refrigerated goods, provided the external door is closed and the dispenser is not in use. As soon as the user opens the external door in order to access the dispenser, the door tray also moves out of the output recess so that refrigerated goods accommodated thereupon cannot restrict access to the dispenser.

In the case of a refrigeration appliance with a body, an external door that can move, in particular pivot relative to the body and an internal door that can move, in particular pivot relative to the body and to the external door and in a closed position the internal door is immovably held between the body and the external door, according to a second aspect of the invention, the object is achieved by an output recess of a dispenser for ice and/or water being provided in the internal door. The output recess, together with the internal door, can therefore also be moved aside, in order to create free access to the storage chamber positioned to the rear of the internal door.

Here too, a door tray can also be provided on the external door in order to be able to use the output recess to store refrigerated goods when the dispenser is not in use.

To provide the refrigeration appliance with an attractive appearance, in accordance with both the first and also the second aspect of the invention, the external door should completely conceal the internal door in the closed position.

Similarly, with both aspects, the external door should be connected to the body by way of the internal door. It can therefore be easily ensured that the internal door remains immobile when the external door is opened and closed and a connection, e.g. a form closure, remains between the body and internal door, which ensures that the internal door does not follow a movement of the external door.

A control element with which the output of ice and/or liquid through the dispenser can be controlled can be arranged in the output recess in order to facilitate the actuation by a container positioned in the output recess.

Provision can further be made for a container, which can be fastened in one position on the external door, in which it is disposed below an outlet of the dispenser in the closed position. For this purpose a container which can be supplied as an accessory to the refrigeration appliance can be provided with fastening means which complement the fastening means of the external door.

Furthermore, the shape of such a container supplied as an accessory can be adjusted to the shape of the recess, in order to completely fill the same when the external door is closed, as far as possible, without hampering the movement of the external door.

Provision can be made for a sensor for detecting the container fastened on the external door and a control unit can be set up to release the output of liquid if the container is fastened on the external door and the external door is in the closed position. Therefore, the container can be filled each time that the external door is closed without the need for a control element, which can be actuated when the external door is open, such as for instance a control paddle used typically to control the water output of a dispenser.

It is therefore expected that the container comes into contact with the control element when the external door is closed, particularly when the shape of the container is optimized with regard to full use of space.

To ensure that the control element does not hamper the engagement of the container into the output recess when the external door is closed it can preferably be arranged on a hinge-side edge of the output recess and can be moved in the width direction of the output recess or, particularly when it is arranged on an edge of the output recess which is remote from the hinge, can be moved in the depth direction of the output recess.

If the container is to fully utilize the space available in the output recess, then it must also be able to move the control element across its entire actuation path. However, with a closed door, ice or water cannot be freely output as a result of a deflection of the control element, since the container would then overflow.

In order to prevent the container from overflowing, the dispenser can be connected to a door positioning sensor and is set up only then to output ice and/or liquid upon actuation of the control element if the door positioning sensor detects an adequate distance between the external door and the internal door and it can therefore be assumed that the actuation goes back to the container which a user has positioned in the output recess when the external door is open and has the intention of filling the same.

A fill level sensor can be provided in the output recess, in order to prevent the container from being filled beyond a predetermined maximum limit. Such a sensor can be provided in addition to the door positioning sensor mentioned above, in order to prevent the container from overflowing when being filled manually; it can however also be provided instead of the door positioning sensor so that if a container engages into the output recess and actuates the control element when the external door is closed, the container is automatically filled. Not only when the door is closed, but also when the door is open, if a user manually positions the container in the output recess.

Further features and advantages of the invention will emerge from the description of exemplary embodiments provided below with reference to the attached figures, in which:

DESCRIPTION OF THE INVENTION

Figure 1:
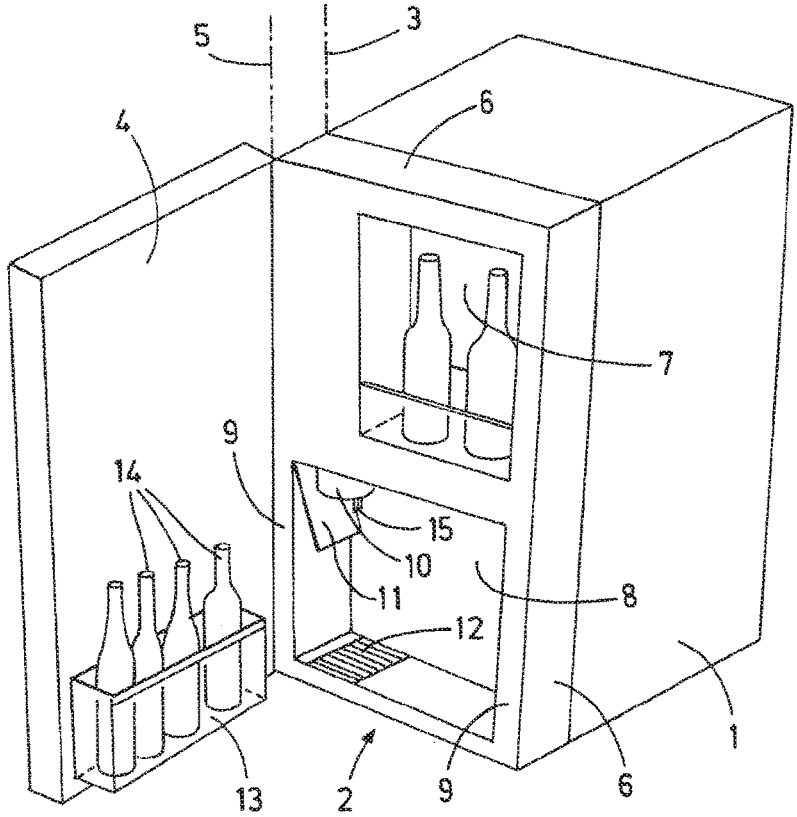
FIG. 1 shows a perspective view of an inventive refrigeration appliance with an open external door.

FIG. 1 shows a schematic perspective view of a refrigeration appliance in what is known as a door-in-door design. In a manner known per se and therefore not shown in detail here, it comprises a body 1 in the form of a square box which is open on its front side. In the display in FIG. 1, the open front side of the body 1 is hidden behind an internal door 2 which is pivotably hinged to the body 1 about an axis 3, here on the front edge of a left side wall of the body 1. In FIG. 1 an external door 4 is disposed in an open position, in which the front side of the internal door 2 is exposed. The external door 4 is hinged on the internal door 2 and can be pivoted about an axis 5 parallel to the axis 3 in a closed position. The internal and external door 2, 4 have the same approach side, so that in the closed position the external door completely covers the front side of the internal door 2 and at best edge surfaces 6 of the internal door 2 remain visible.

Two recesses 7, 8 are cut out on the front side of the internal door 2. The lower of the two recesses, referred to below as output recess 8, extends between narrow external walls 9 across approximately the entire width of the internal door 2. Apart from a dispenser outlet 10 in its left upper corner and a control paddle 11 adjacent to the dispenser outlet 10, the output recess 8 is empty. The control paddle 11 can be deflected here askew, toward the adjacent external wall 9. Alternatively, it could also be arranged in front of the rear wall of the output recess 8 and be deflectable onto the rear wall. A drip catcher tray 12 is embedded below the dispenser outlet 10 in the bottom of the output recess 8.

The upper of the two recesses 7 only assumes one part of the width of the internal door 2, so that above the dispenser outlet 10 space is available for a tank embedded in the internal door 2. This tank can be connected to a water line, in order to be automatically filled again when water at the dispenser outlet 10 is removed; alternatively or in addition, it can have a filler stub, by way of which any fluid can be freely filled manually, in order to be output by way of the dispenser outlet 10. Alternatively, the dispenser recess 8 can be connected via the dispenser outlet 10 to a cutout which opens toward the rear side of the internal door 2, into which cutout a water tank mounted in the body 1 and/or an ice maker can engage in order to output water or ice via the dispenser outlet 10 to a vessel positioned in the dispenser recess 8 below the outlet 10.

A door tray 13 is positioned on the rear side of the external door 4 such that if the external door is pivoted in its closed position which rests against the front side of the internal door 4, the door tray 13 and if necessary refrigerated goods positioned thereupon, here bottles 14, engage into the dispenser recess 8. The external door 4 contains a heat-insulating filler, the internal door 2 on the other hand does not, so that if both doors 2, 4 are closed, the recesses 7, 8 are cooled by way of the storage chamber positioned behind the internal door 2.

The width of the door tray 13 is slightly smaller here than that of the output recess 8, so that when the external door 4 is in the closed position, the door tray 13 does not extend below the dispenser outlet 10. The bottles 14 on the door tray 13 can therefore not come into contact with the control paddle 11 and an unintentional actuation of the control paddle by one of these bottles 14 when closing the external door 4 is ruled out.

Figure 2:
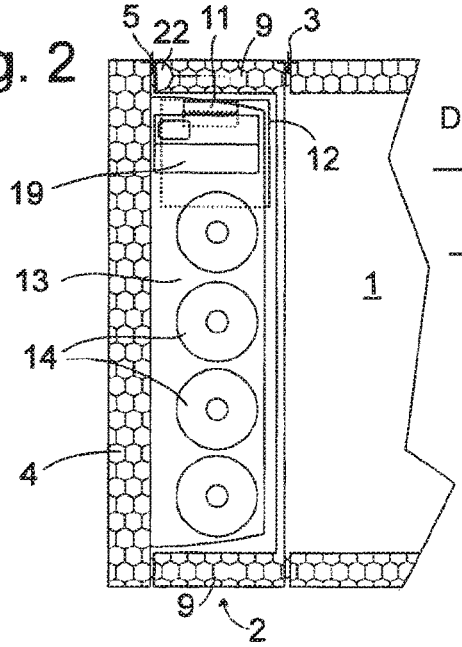
FIG. 2 shows a sectional view through an inventive refrigeration appliance with a closed external door.

Improved use of space can be achieved if the door tray 13 extends, as shown in FIG. 2, across the entire width of the output recess 8 to below the dispenser outlet 10. However, when the external door 4 is closed refrigerated goods which rest on the door tray 13 can then come into contact with the control paddle 11 and deflect this. To ensure that this does not lead to an uncontrolled output of ice or water when the external door 4 is closed, in accordance with a further development of the invention a fill level sensor 15 (see FIG. 1, 3) can be provided. The fill level sensor can be accommodated at the dispenser outlet 10 for instance and set up to detect the distance between the dispenser outlet 10 and the water level in a container. The fill level sensor 15 only releases the output of water into the container if it detects a surface considered to be a surface of the water below the dispenser outlet 10 and this surface lies below a predetermined limit. Therefore each time the external door 4 is closed and a suitable container is disposed on the door tray 13 in a position suitable for actuating the control paddle 11, this container is filled to the predetermined limit so that a container full of cold water is always available.

Figure 3:
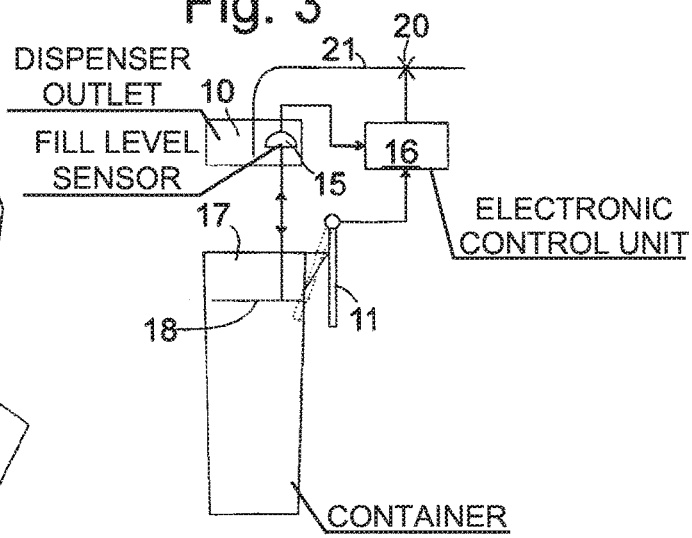
FIG. 3 shows a block diagram of a water dispenser.

Provision can be made, as shown in the block diagram in FIG. 3, for an electronic control unit 16 to be connected with the fill level sensor 15, in order to monitor the change in the detected fill level during a filling process. If this is not expected or not expected as quickly as with the aid of the flow rate of the dispenser, then it can be concluded that the water does not reach the container 17 e.g. because the surface 18 detected by the sensor 15 is the top side of a vessel unsuited to filling, e.g. a beverage carton 19. In this case the control unit 16 immediately closes a solenoid valve 20 in a water line 21 running from the water tank to the dispenser outlet 10 in order to conclude the output of water from the water tank.

Alternatively, a weight sensor, which can be positioned here in the door tray 13 for instance so that it is exposed to the weight of the container to be filled, can also be used as a fill level sensor. If the empty weight and capacity of the container are known, a maximum weight which the container is permitted to reach before the control unit 16 terminates the filling process in order to prevent the container from overflowing can be calculated therefrom.

Here too, provision can be made for the control unit 16 to cancel the filling process immediately if it is determined that this does not increase the weight detected by the sensor, since it can then be assumed that the container is actually overflowing or the output water does not reach the container for different reasons.

According to a further alternative, a switch or sensor 22 (see FIG. 2) for detecting the position of the external door 4 relative to the internal door 2 can be connected to the control unit 16, and the control unit 16 is set up only then to open the solenoid valve 20, upon deflection of the control paddle 11, if the sensor 22 simultaneously indicates an open position of the external door 4. Therefore water can then be output when a user is holding the container 17 below the dispenser outlet 10 and in doing so is pressing against the control paddle 11; when, however, an object on the door tray 13 deflects the control paddle 11 when the external door 4 is closed, the solenoid valve 20 remains closed because at the same time the sensor 22 indicates the closed position of the external door 4.

Figure 4:
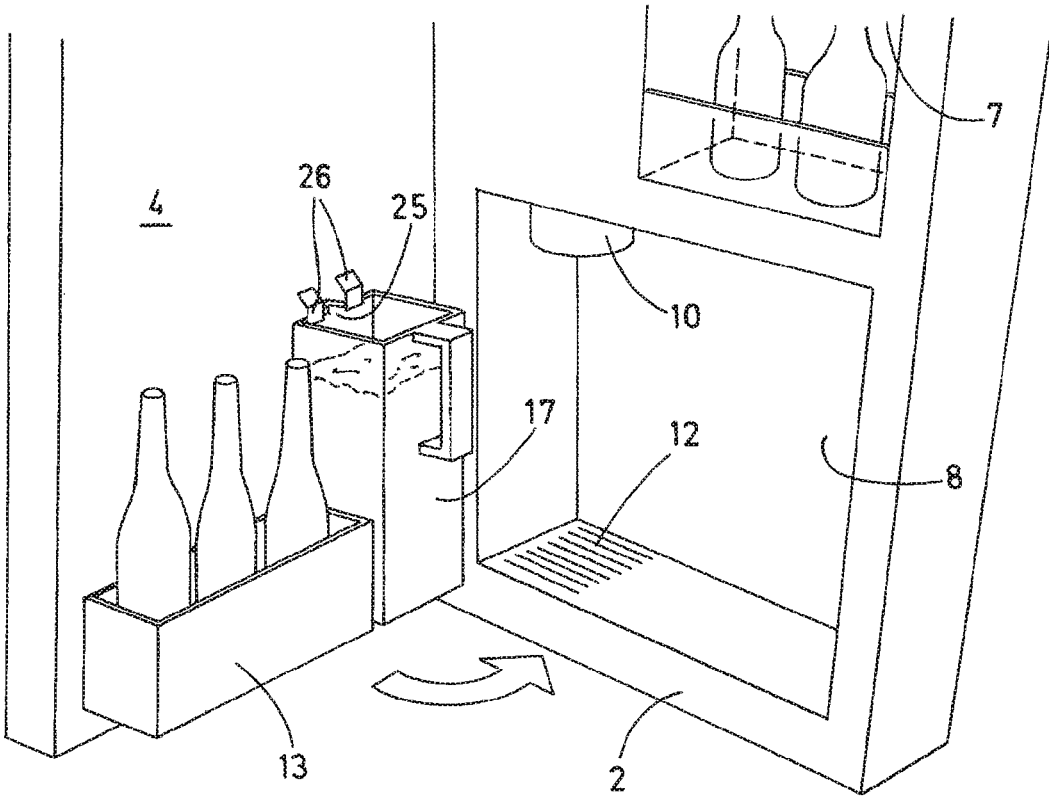
FIG. 4 shows the lower area of the internal and external door of a refrigeration appliance according to a further embodiment of the invention.
Figure 5:
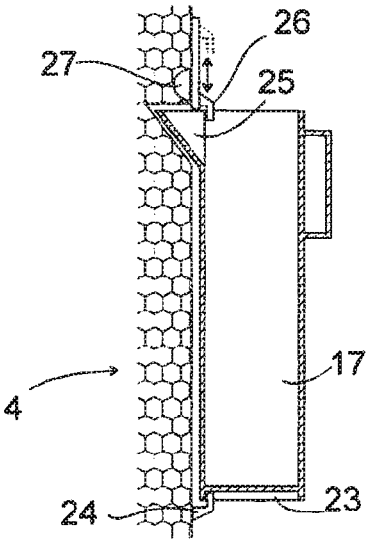
FIG. 5 shows a sectional view through the external door and the container suspended thereon according to the embodiment in FIG. 4.

FIG. 4 shows in each case the lower region of the internal door 2 and external door 4 according to a further embodiment of the invention. The door tray 13 is shortened here compared with FIG. 2, so that even when the external door 4 is closed, it does not extend beyond the drip catcher tray 12. The container 17 to be filled is suspended adjacent to the door tray 13 on the interior of the external door 4. Latching means which are not visible in FIG. 4 and are only suitable for the container 17 are used to suspend the container 17. E.g. the container 17 shown in FIG. 5 can have a bottom-side cutout 23, into which a stationary hook 24 of the external door 4 engages from below, while at the same time vertically movable hooks 26 surround a wall of the container 17 from above on both sides of a pourer 25. If a sensor 27 of the control unit 16 shows that the hooks 16 are disposed above a rest position at a height characteristic of the container 17, then the control unit 16 recognizes that the container 17 is properly installed. Only in this case does the solenoid valve 20 open, when the external door 4 is closed, until the water level sensor 15 indicates a predetermined target fill level of the container 17. This ensures that the user finds the container 17 full each time the external door 4 is opened.

Since the hook 24 supports the entire weight of the container 17, as mentioned above a weight sensor arranged on this hook can be used as a fill level sensor. Alternatively, the container 17 itself could also be provided with a weight sensor, on which the hook 24 acts in the installed state. Such a sensor can communicate wirelessly with the control unit 16, e.g. by way of a Bluetooth interface; the time and effort involved in laying a signal line through the external door 4 to the control unit 16 can thus be avoided.

The control paddle 11 is not shown in FIG. 4; in this embodiment it can be omitted since it is not required to automatically fill the container 17. It can still be provided in order to be able to fill any container when the external door 4 is open.

Figure 6:
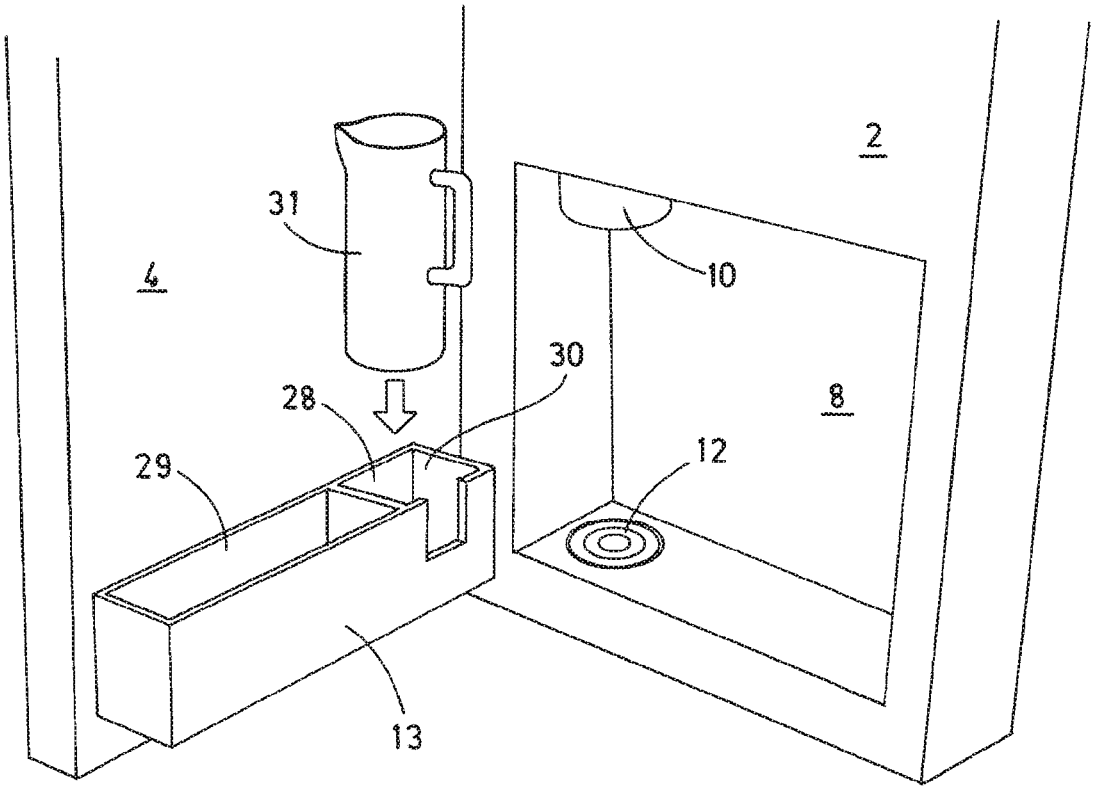
FIG. 6 shows a view analogous to FIG. 4 according to another modified embodiment.

FIG. 6 shows another modification of the refrigeration appliance in a view analogous to FIG. 4. The door tray 13 extends here in turn across the entire length of the output recess 8, it is however split by a transverse wall 28 into one region 29, in which any objects can be positioned, without influencing the mode of operation of the water dispenser, and another region 30 which is provided to receive the container 17 therein. Switches or sensors which are arranged in the cutout of the region 30 which receives the container 17 and is upwardly open are used to identify, on the basis of the contour of the container or a specific encoding, whether a container positioned in the region 30 is the container 17 supplied as an accessory to the inventive refrigeration appliance or is any other container 31. Therefore on the one hand the entire length of the door tray 13 can be used for any refrigerated goods, on the other hand a reliable automatic filling is possible when the external door 4 is closed, when the control unit 16 clearly identifies the container 17 on the basis of the sensors of the region 30. If another container 30 or no container is disposed in the region 30, then the solenoid valve 20 remains closed when the external door 4 is closed and the automatic filling is stopped.

REFERENCE CHARACTERS

1 Body
2 Internal door
3 Axis
4 External door
5 Axis
6 Edge surface
7 Recess
8 Output recess
9 External wall
10 Dispenser outlet
11 Control paddle
12 Drip catcher tray
13 Door tray
14 Bottle
15 Fill level sensor
16 Control unit
17 Container
18 Surface
19 Beverage carton
20 Solenoid valve
21 Water line
22 Sensor
23 Cutout
24 Hook
25 Pourer
26 Hook
27 Sensor
28 Transverse wall
29 Region
30 Region
31 Container

The invention claimed is:

1. A refrigeration appliance, comprising:

a body;

an external door being movable relative to said body;

an internal door being movable relative to said body and being movable relative to said external door, said internal door being immovably held between said body and said external door in a closed position of said external door;

a dispenser for at least one of ice or water, said dispenser having an output recess in said internal door;

a control element disposed in said output recess, said dispenser being configured to output at least one of ice or liquid when said control element is actuated;

said dispenser having an outlet, and a container configured for being fastened to said external door in a position below said outlet of said dispenser in said closed position of said external door; and a sensor for detecting said container fastened on said external door, and a control unit configured for releasing an output of liquid when said container is fastened to said external door and said external door is in said closed position.

2. The refrigeration appliance according to claim 1, which further comprises a door tray attached to said external door, said door tray engaging into said output recess in said closed position of said external door.

3. The refrigeration appliance according to claim 1, wherein said internal door has a front side, and said external door completely conceals said front side of said internal door in said closed position of said external door.

4. The refrigeration appliance according to claim 1, wherein said internal door connects said external door to said body.

5. The refrigeration appliance according to claim 1, wherein said control element is a manually actuated paddle.

6. The refrigeration appliance according to claim 1, wherein said control element is configured to be actuated by said container in said closed position of said external door.

7. The refrigeration appliance according to claim 5, wherein said internal door has a hinge, said output recess has a hinge-side edge and a width direction, and said control element is disposed on said hinge-side edge of said output recess and is movable in said width direction of the output recess.

8. The refrigeration appliance according to claim 5, wherein said output recess has a depth direction, and said control element is movable in said depth direction of said output recess.

9. The refrigeration appliance according to claim 1, which further comprises a fill level sensor for detecting a fill level of said container.

10. A refrigeration appliance, comprising:

a body;

an external door being movable relative to said body;

an internal door being movable relative to said body and being movable relative to said external door, said internal door being immovably held between said body and said external door in a closed position of said external door;

a dispenser for at least one of ice or water, said dispenser having an output recess in said internal door;

a control element disposed in said output recess, said dispenser being configured to output at least one of ice or liquid when said control element is actuated;

said dispenser having an outlet, and a container configured for being fastened to said external door in a position below said outlet of said dispenser in said closed position of said external door; and a door positioning sensor connected to said dispenser, said dispenser being configured to only output at least one of ice or liquid when said control element is actuated and said door positioning sensor detects an adequate distance between said external door and said internal door for an open position of said external door from said internal door.

* * * * *